US006709254B2

(12) United States Patent
Cook et al.

(10) Patent No.: US 6,709,254 B2
(45) Date of Patent: Mar. 23, 2004

(54) TILTABLE WEB FORMER SUPPORT

(75) Inventors: Michael C. Cook, Marietta, GA (US); Stephen T. Farmer, Jr., Fort Worth, TX (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 193 days.

(21) Appl. No.: 09/981,374

(22) Filed: Oct. 17, 2001

(65) Prior Publication Data

US 2002/0050329 A1 May 2, 2002

Related U.S. Application Data

(60) Provisional application No. 60/243,996, filed on Oct. 27, 2000.

(51) Int. Cl.[7] ..... D04H 1/04; D04H 3/16

(52) U.S. Cl. ..... 425/130; 425/7; 425/83.1; 425/190; 425/447; 425/471

(58) Field of Search ..... 425/7, 83.1, 130, 425/190, 223, 224, 363, 447, 471

(56) References Cited

U.S. PATENT DOCUMENTS

| | | | |
|---|---|---|---|
| 3,338,992 | A | 8/1967 | Kinney |
| 3,341,394 | A | 9/1967 | Kinney |
| 3,502,763 | A | 3/1970 | Hartmann |
| 3,542,615 | A | 11/1970 | Dobo et al. |
| 3,692,618 | A | 9/1972 | Dorschner et al. |
| 3,740,791 | A | 6/1973 | Bulin |
| 3,802,817 | A | 4/1974 | Matsuki et al. |
| 3,849,241 | A | 11/1974 | Butin et al. |
| 4,319,957 | A | 3/1982 | Bartelmuss |
| 4,321,108 | A | 3/1982 | Goddard et al. |
| 4,340,563 | A | 7/1982 | Appel et al. |
| 4,450,630 | A | 5/1984 | Phelps |
| 4,523,978 | A | 6/1985 | Pullinen |
| 4,717,267 | A | 1/1988 | Barthel |
| 4,724,047 | A | 2/1988 | Creagan et al. |
| 4,794,663 | A | 1/1989 | Vosbikian |
| 4,865,692 | A | 9/1989 | Kade et al. |
| 5,057,368 | A | 10/1991 | Largman et al. |
| 5,061,347 | A | 10/1991 | Bubik et al. |
| 5,069,970 | A | 12/1991 | Largman et al. |
| 5,099,539 | A | 3/1992 | Forester |
| 5,129,992 | A | 7/1992 | Schiel et al. |
| 5,169,500 | A | 12/1992 | Mejdell |
| 5,262,009 | A | 11/1993 | Schiel et al. |
| 5,277,976 | A | 1/1994 | Hogle et al. |
| 5,310,482 | A | 5/1994 | Sather |
| 5,466,410 | A | 11/1995 | Hills |
| 5,660,689 | A | 8/1997 | Bartelmuss et al. |
| 6,101,675 | A | 8/2000 | Goldstein |

FOREIGN PATENT DOCUMENTS

| | | |
|---|---|---|
| DE | 19547767 | 2/1998 |

*Primary Examiner*—James P. Mackey
(74) *Attorney, Agent, or Firm*—Pauley Petersen & Erickson

(57) ABSTRACT

A support for a web forming machine which allows for vertical adjustment of a web forming belt with respect to at least one die head positioned above the web forming belt, and allows for tilting of the web forming belt. The support allows linear motion along a y-axis defined by a length of a guide shaft while preventing linear motion along a x-axis and a z-axis, e.g. the two axes perpendicular to the y-axis. Further, the support allows rotational or axial motion about the x-axis perpendicular to the y-axis but prevents rotational or axial motion about the y-axis and the z-axis.

19 Claims, 10 Drawing Sheets

TILTABLE WEB FORMER SUPPORT

CROSS REFERENCE TO RELATED APPLICATION

This application claims the benefit of U.S. Provisional Application No. 60,243,996, filed Oct. 27, 2000.

BACKGROUND OF THE INVENTION

1. Field of the Invention

This invention relates to a support for a web forming machine. More particularly, this invention relates to a support for a web forming machine which allows for vertical adjustment of a web forming belt with respect to at least one die head positioned above the web forming belt, and allows for tilting of the web forming belt.

2. Description of Prior Art

Conventional supports or guide posts for supporting a web forming machine prevent any lateral or vertical movement of the web forming machine. Further, because the conventional guide posts also prevent any rotational movement or tilting of the web forming machine, the web forming belt is not allowed to tilt or slope with respect to a base of the web forming machine.

In order to provide for tilting of the conventional web forming machines, as is often desired during polymer extrusion applications, the conventional guide posts must be mechanically bent. Thus, these guide posts are generally constructed of an easily bendable material. As a result of using easily bendable materials for the construction of the guide posts, the guide posts do not provide proper lateral restraint for the web forming machine. Additionally, mechanical binding and/or bending of the web forming belt occurs as it moves across the conventional guide posts. Further, the web forming belt cannot be vertically positioned and/or adjusted with respect to the die heads using conventional guide posts.

It is apparent that there is a need for a support for a web forming machine which allows the vertical positioning and/or adjustment of the web forming belt with respect to the die heads positioned above the web forming belt.

It is also apparent that there is a need for a support for a web forming machine which allows for rotational or axial positioning and/or adjustment of the support to prevent mechanical binding and/or bending of the web forming belt as it moves across the supports.

SUMMARY OF THE INVENTION

In response to the discussed difficulties and problems encountered in the prior art, a support for a web forming machine which provides linear motion along a y-axis and rotational motion about a x-axis perpendicular to the y-axis, has been discovered. The support for the web forming machine allows a web forming belt to be vertically positioned with respect to die heads positioned along the length of the web forming belt. Further, the support can be axially or rotationally positioned to maintain an outer surface of the web forming belt in a generally flat or planar orientation and to prevent mechanical binding and/or bending of the web forming belt as the web forming belt moves across the support.

During polymer extrusion applications, it is often desirable to increase or decrease the vertical distance between the web forming belt and the successive die heads. For example, a first vertical distance between a first die head and the web forming belt may be about 12 inches, a second vertical distance between a second die head, downstream from the first die head, and the web forming belt may be about 13 inches, and a third vertical distance between a third die head, downstream from the second die head, and the web forming belt may be about 14 inches. As the vertical distances between successive die heads and the web forming belt increase or decrease, the web forming belt will have either a positive or negative slope, respectively, with respect to a base of the web forming machine.

The support according to this invention allows linear motion along the y-axis defined by the length of the guide shaft while preventing linear motion along the x-axis and a z-axis, e.g. the two axes perpendicular to the y-axis. Further, the support allows rotational or axial motion about the x-axis perpendicular to the y-axis but prevents rotational motion about the y-axis and the z-axis.

With the foregoing in mind, it is a feature and advantage of this invention to provide a support for a web forming machine which allows for the vertical adjustment of a web forming belt with respect to a die head of the web forming machine while preventing either lateral or longitudinal movement of the web forming machine.

It is also a feature and advantage of this invention to provide a support for a web forming machine which allows for tilting or sloping of a web forming belt to vary a distance between the web forming belt and successive die heads and prevent subsequent mechanical binding and/or bending of the web forming belt.

BRIEF DESCRIPTION OF THE DRAWINGS

These and other objects and features of this invention will be better understood from the following detailed description taken in conjunction with the drawings wherein.

DEFINITIONS

Figure 1:
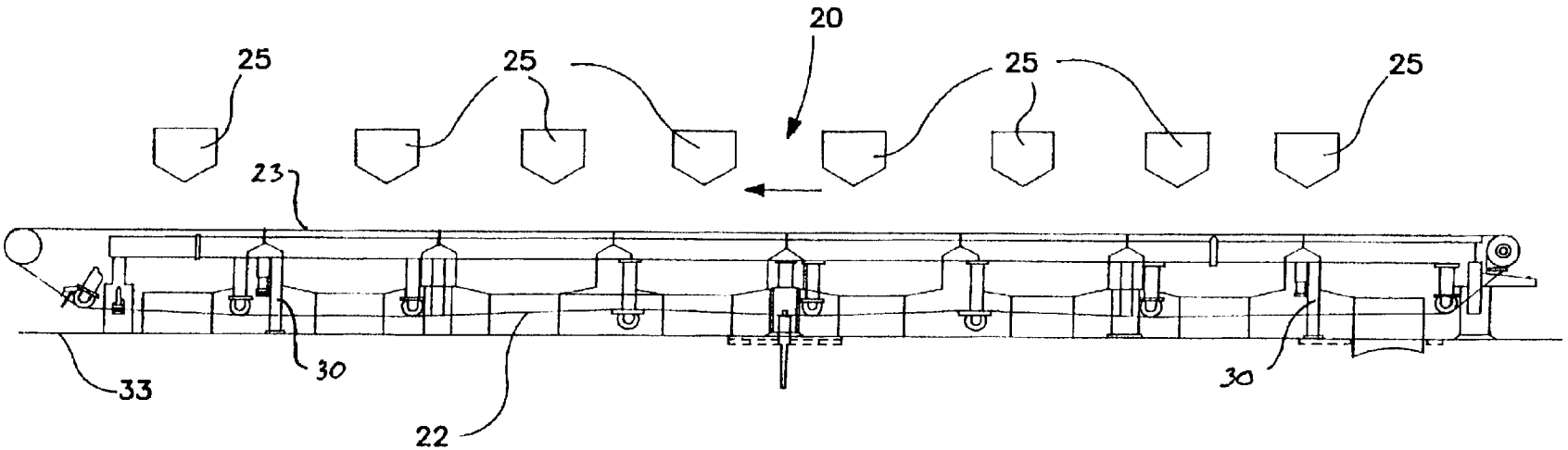
FIG. 1 is a side view of a web forming machine, in accordance with one embodiment of this invention.

As used herein, the term "web" is related, for example to a nonwoven web, but it is understood by one having ordinary skill in the art that the term includes, but is not limited to, other materials in sheet and film form.

As used herein, "longitudinal", "transverse" and "lateral" have their customary meaning. The longitudinal axis lies in the plane of the web forming machine and is generally parallel to a machine direction. The term "x-axis" refers to an axis which lies in the plane of the support and is generally perpendicular to the longitudinal axis. The term "y-axis" refers to an axis which lies in the plane of the support and is generally perpendicular to the x-axis.

As used herein, the term "major axis" refers to the axis of an ellipse that passes through the two foci.

As used herein, the term "minor axis" refers to the axis of an ellipse that is perpendicular to the major axis at a point equidistant from the foci.

As used herein, the term "polymer" generally includes, but is not limited to, homopolymers, copolymers, such as for example, block, graft, random and alternating copolymers, terpolymers, etc., and blends and modifications thereof. In addition, unless otherwise specifically limited, the term "polymer" also includes all possible geometric configurations of the molecule. These configurations include, but are not limited to, isotactic, atactic, syndiotactic and random symmetries.

As used herein, the term "nonwoven" or "nonwoven web" means a structure of individual fibers or threads which are interlaid, but not in an identifiable repeating manner. Nonwoven webs have been, in the past, formed by a variety of processes such as, for example, meltblowing processes, spunbonding processes, coforming processes, hydroentangling, air-laid and bonded carded web processes.

As used herein, the term "spunbond fibers" refers to small diameter fibers which are formed by extruding molten thermoplastic material as filaments from a plurality of fine, usually circular capillaries of a spinneret, with the diameter of the extruded filaments then being rapidly reduced as by, for example, in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartmann, and U.S. Pat. No. 3,542,615 to Dobo et al. Spunbond fibers are generally not tacky when they are deposited onto a collecting surface. Spunbond fibers are generally continuous and have average diameters (from a sample of at least 10 fibers) larger than 7 microns, more particularly, between about 10 and 30 microns. The fibers may also have shapes such as those described in U.S. Pat. No. 5,277,976 to Hogle et al., U.S. Pat. No. 5,466,410 to Hills, and U.S. Pat. No. 5,069,970 and U.S. Pat. No. 5,057,368 to Largman et al., which describe hybrids with unconventional shapes. A nonwoven web of spunbond fibers produced by melt spinning is referred to as a "spunbond web".

As used herein, the term "meltblown fibers" means fibers formed by extruding a molten thermoplastic material through a plurality of fine, usually circular, die capillaries as molten threads or filaments into converging high velocity, usually hot, gas (for example, air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, by U.S. Pat. No. 3,849,241 to Butin et al. Meltblown fibers are microfibers which may be continuous or discontinuous, are generally smaller than 10 microns in average diameter. A nonwoven web of meltblown fibers is referred to as a "meltblown web".

As used herein, the term "bonded carded web" refers to webs made from staple fibers which are sent through a combing or carding unit, which breaks apart and aligns the staple fibers in the machine direction to form a generally machine direction-oriented fibrous nonwoven web. Such fibers are usually purchased in bales which are placed in a picker or fiberizer which separates the fibers prior to the carding unit. Once the web is formed, it is then bonded by one or more of several known bonding methods.

These terms may be defined with additional language in the remaining portions of the specification.

DETAILED DESCRIPTION OF PRESENTLY PREFERRED EMBODIMENTS

Figure 2:
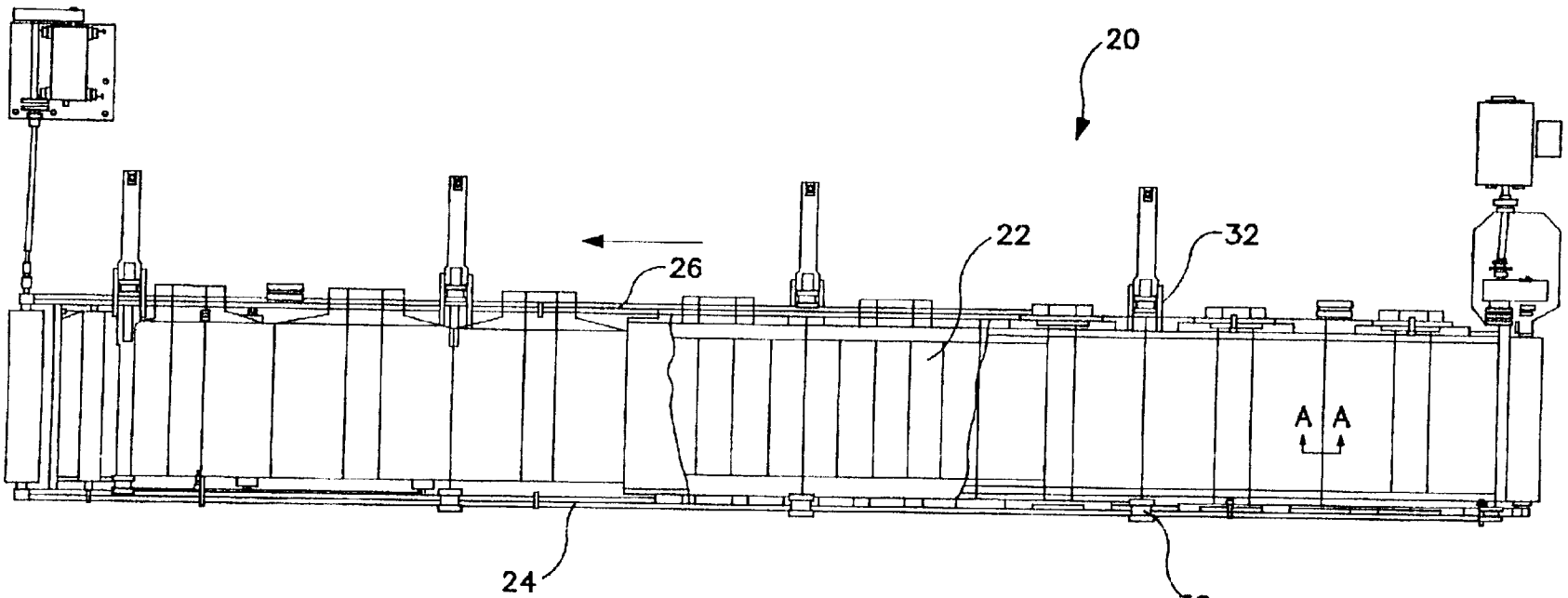
FIG. 2 is a top view of a web forming machine, in accordance with one embodiment of this invention.

Referring to FIGS. 1 and 2, a web forming machine 20 has a web forming belt 22 which rotates or moves in a machine direction, as indicated by the arrow and may have a length of about 80 feet or greater for certain applications. The web forming machine 20 may produce or form nonwoven webs or fabrics using a variety of conventional polymer extrusion processes such as, for example, meltblowing processes, spunbonding processes, coforming processes, hydroentangling, air-laid and bonded carded web processes. At least one die head 25, as shown in FIG. 1, is positioned vertically with respect to an outer surface of the web forming belt 22 and traverse to the machine direction, e.g. in a cross-machine direction. In accordance with one embodiment of this invention, a plurality of die heads 25, for example eight (8) die heads 25 are fixedly positioned above the web forming belt 22 along the length of the web forming belt 22. Each die head 25 may be different than the other die heads 25 and/or extrude different polymeric material than the other die heads 25. As the web forming belt 22 moves in the machine direction, fibers or filaments are extruded from each die head 25 and are deposited onto the web forming belt 22 to form a nonwoven web or fabric.

Figure 3:
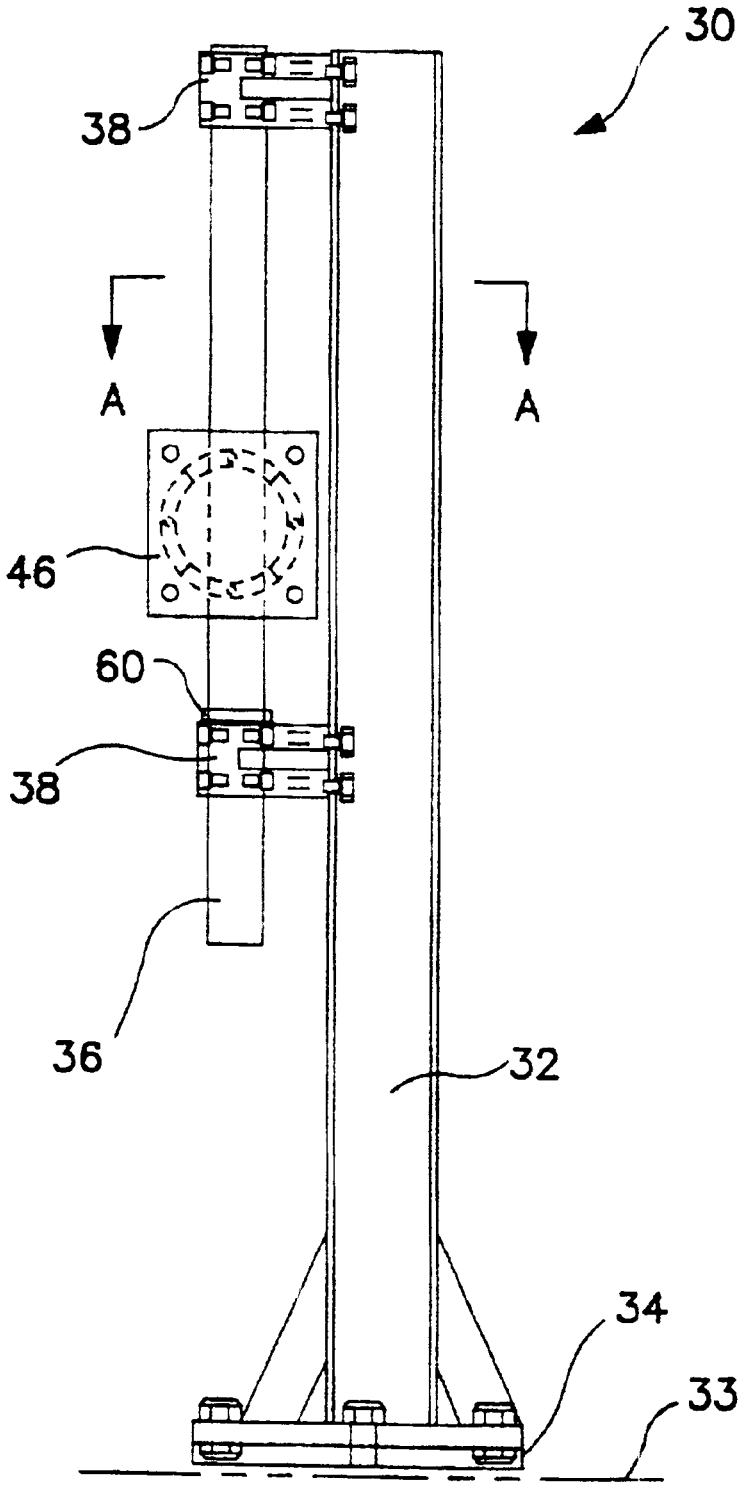
FIG. 3 is a front view of a support for a web forming machine, in accordance with one embodiment of this invention.
Figure 4:
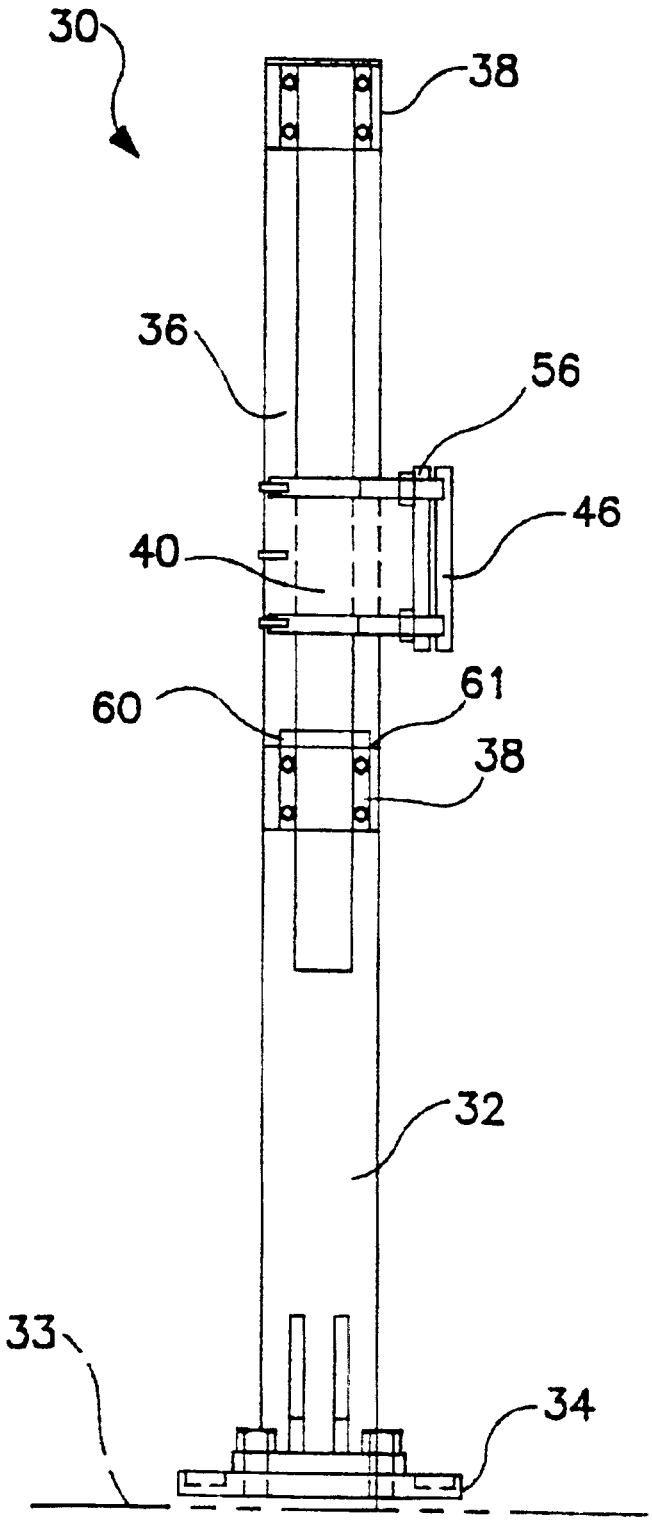
FIG. 4 is a side view of a support for a web forming machine, in accordance with one embodiment of this invention.
Figure 5:
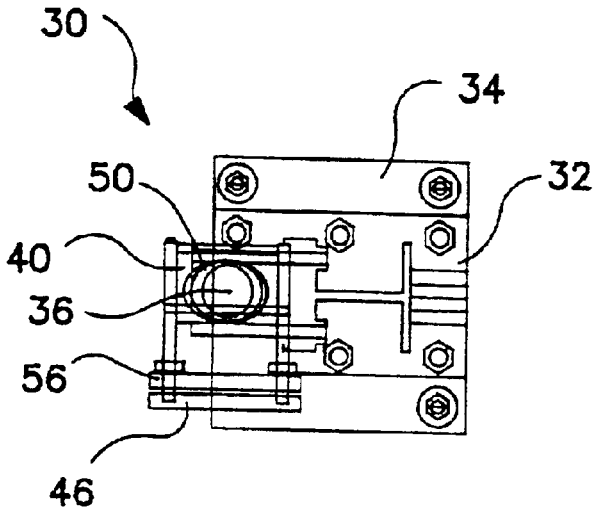
FIG. 5 is a cross-sectional top view through line A—A of a support for a web forming machine, in accordance with one embodiment of this invention.

During polymer extrusion applications, it is often desirable to vary a vertical distance between the web forming belt 22 and each die head 25 positioned along the length of the web forming belt 22 in order to deposit fibers or filaments onto the web forming belt 22 to form layers of extruded material. In accordance with one embodiment of this invention, a support 30 for the web forming machine 20, as shown in FIGS. 3–5, provides support to the web forming machine 20 and allows the web forming belt 22 to be vertically positioned and/or adjusted with respect to the die heads 25 positioned along the length of the web forming belt 22. Further, the support 30 can be axially or rotationally positioned and/or adjusted to maintain the outer surface of the web forming belt 22 in a generally flat or planar orientation and to prevent mechanical binding and/or bending of the web forming belt 22 as the web forming belt 22 moves across the support 30.

In accordance with one embodiment of this invention, the support 30 for the web forming machine 20 has at least one guide post 32 rigidly mounted to a base 33, for example a floor of a production plant. Desirably, the guide post 32 has a conventional I-beam cross-sectional shape and is constructed or fabricated of hot rolled steel. The guide post 32 may have any suitable cross-sectional shape and other suitable materials may be used to construct or fabricate the guide post 32 which exhibit the necessary strength. The guide post 32 may be rigidly mounted to the floor using conventional fastening means suitable for mounting heavy equipment, for example suitably-sized bolts. Further, a guide post base plate 34 may be positioned between the guide post 32 and the floor for added structural support. The guide post base plate 34 may be made of hot rolled steel or other suitable material capable of providing the required support.

Desirably, a plurality of corresponding guide posts 32 are positioned along a length of the web forming machine 20 with one guide post 32 on a first side portion 24 of the web forming machine 20 and a corresponding guide post 32 positioned on a second laterally opposing side portion 26 of the web forming machine 20, as shown in FIG. 2.

Figure 6:
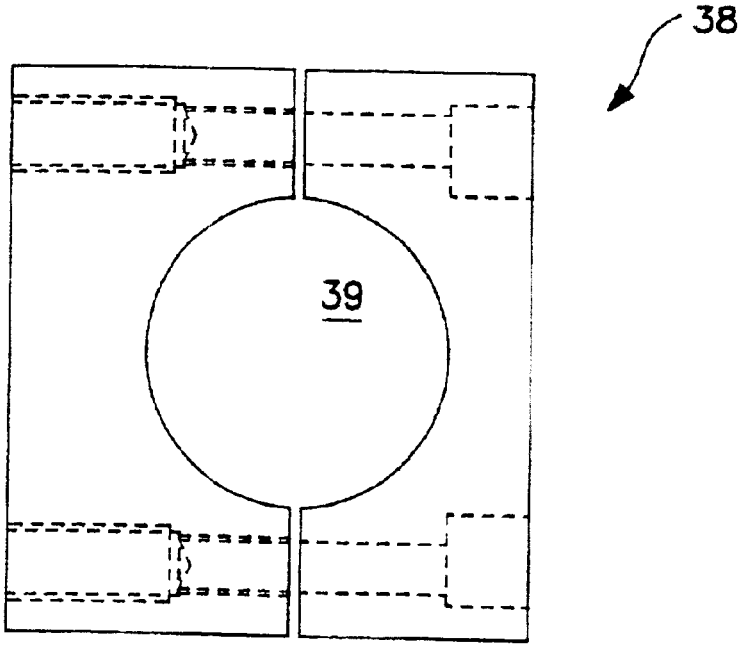
FIG. 6 is a top view of a guide shaft clamp block for mounting a guide shaft to a guide post, in accordance with one embodiment of this invention.
Figure 7:
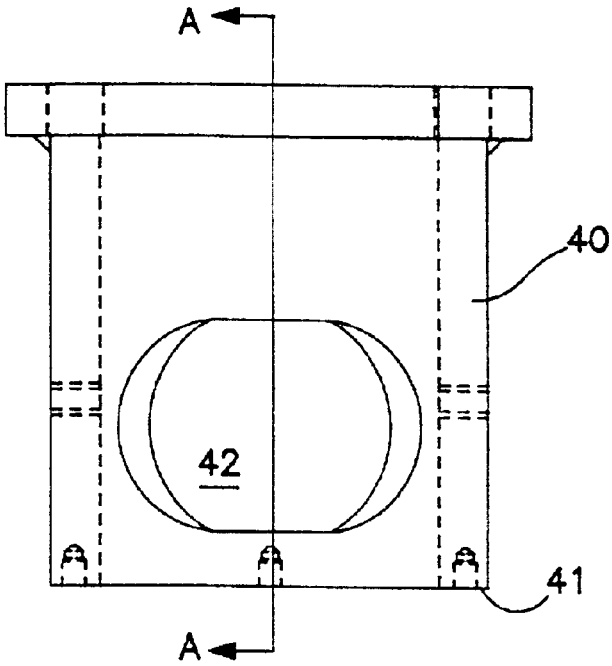
FIG. 7 is a top view of a bushing housing, in accordance with one embodiment of this invention.

In accordance with one embodiment of this invention, a guide shaft 36 is fixedly mounted or connected to the guide post 32. Desirably, the guide shaft 36 is mounted to the guide post 32 with at least one guide shaft clamp block 38. As shown in FIG. 6, the guide shaft clamp block 38 has two components which when fitted together form a bore 39, which is positionable about the guide shaft 36. The guide shaft clamp block 38 is fastened to the guide post 32 using conventional fastening means, for example a plurality of suitably-sized bolts and corresponding nuts. As shown in FIGS. 3 and 4, a first guide shaft clamp block 38 is positioned at a first end portion of the guide shaft 36 and a second guide shaft clamp block 38 is positioned at an opposite second end portion of the guide shaft 36 to fixedly mount the guide shaft 36 to the guide post 32. The guide shaft 36 has a length which defines a y-axis generally perpendicular to a base of the web forming machine 20. The guide shaft 36 desirably has a solid cross-section and is made of steel or another suitably strong material. In accordance with one embodiment of this invention, the guide shaft 36 is produced by Thompson, Inc. and has a length of about 5 feet and an outer diameter of about 4.0 inches. The guide shaft may have any suitable length and/or outer diameter.

Figure 8:
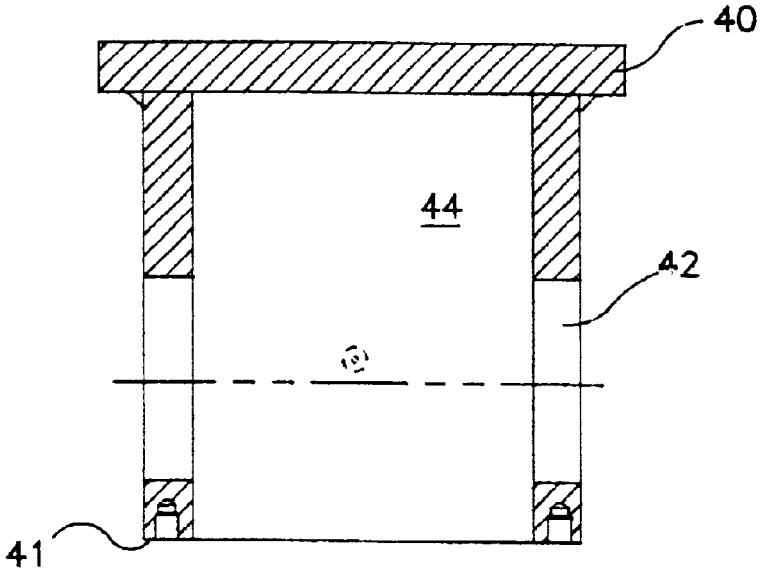
FIG. 8 is a cross-sectional view of a bushing housing, in accordance with one embodiment of this invention.
Figure 9:
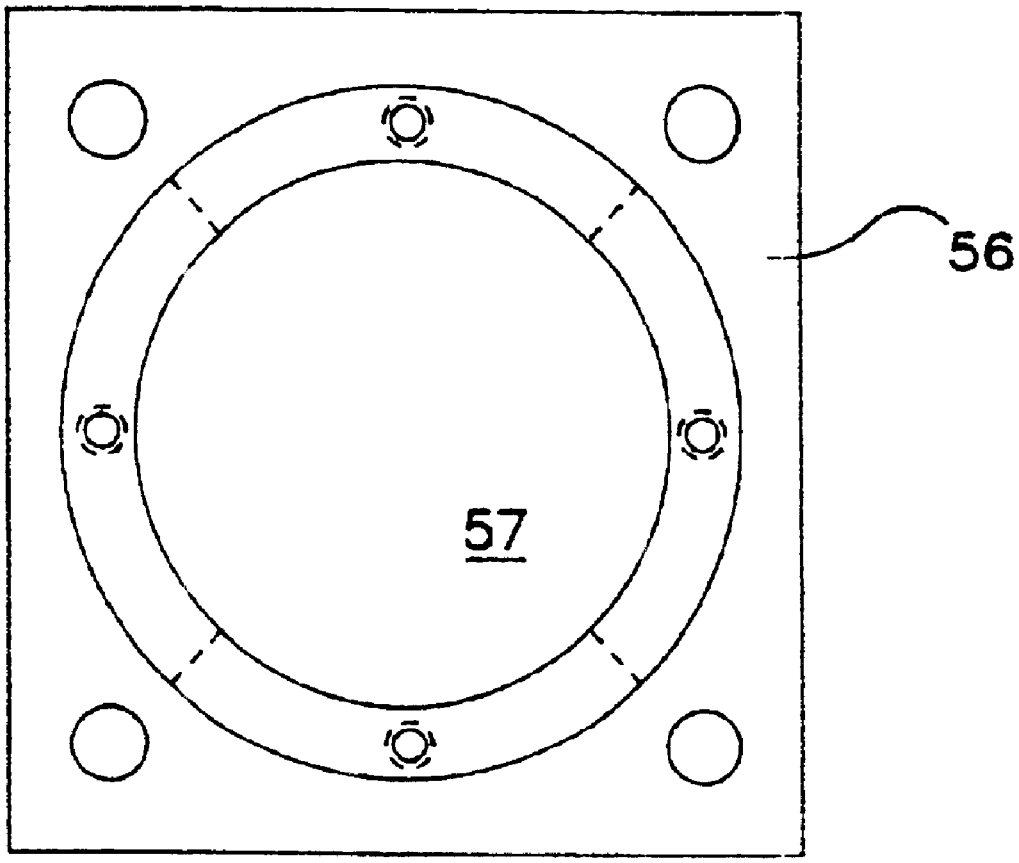
FIG. 9 is a front view of a bushing housing cover plate, in accordance with one embodiment of this invention.

In accordance with one embodiment of this invention, the support 30 has a bushing housing 40 positionable about the guide shaft 36. Desirably, the bushing housing 40 is made of stainless steel and forms a bore 42 slightly larger than a circumference of the guide shaft 36. In accordance with one embodiment of this invention, the bushing housing 40 forms the bore 42 having a generally elliptical or oval cross-section with a major axis greater than the outer diameter of the guide shaft 36 and a minor axis about equal to but slightly larger than the outer diameter of the guide shaft 36. The bore 42 may have any suitable cross-sectional shape. As shown in FIG. 8, the bushing housing 40 forms a cylindrical cavity 44 which intersects with the bore 42. Desirably, a bushing housing cover plate 56, as shown in FIG. 9, having an aperture 57 coaxially aligned with the cavity 44 is fastened to an end surface 41 of the bushing housing 40 using conventional fastening means, for example screws.

Figure 10:
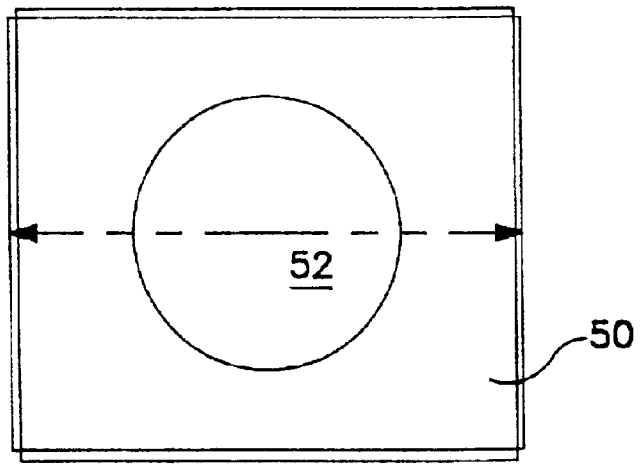
FIG. 10 is a top view of a guide bushing, in accordance with one embodiment of this invention.
Figure 11:
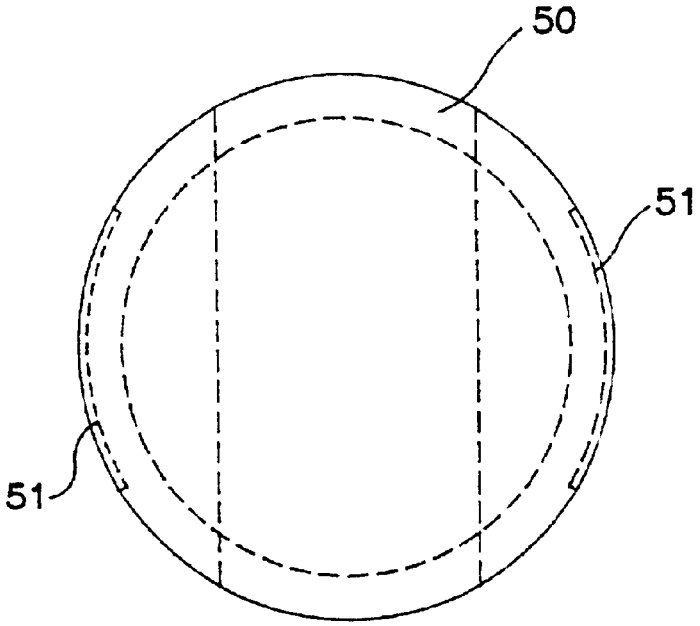
FIG. 11 is a front view of a guide bushing, in accordance with one embodiment of this invention.
Figure 12:
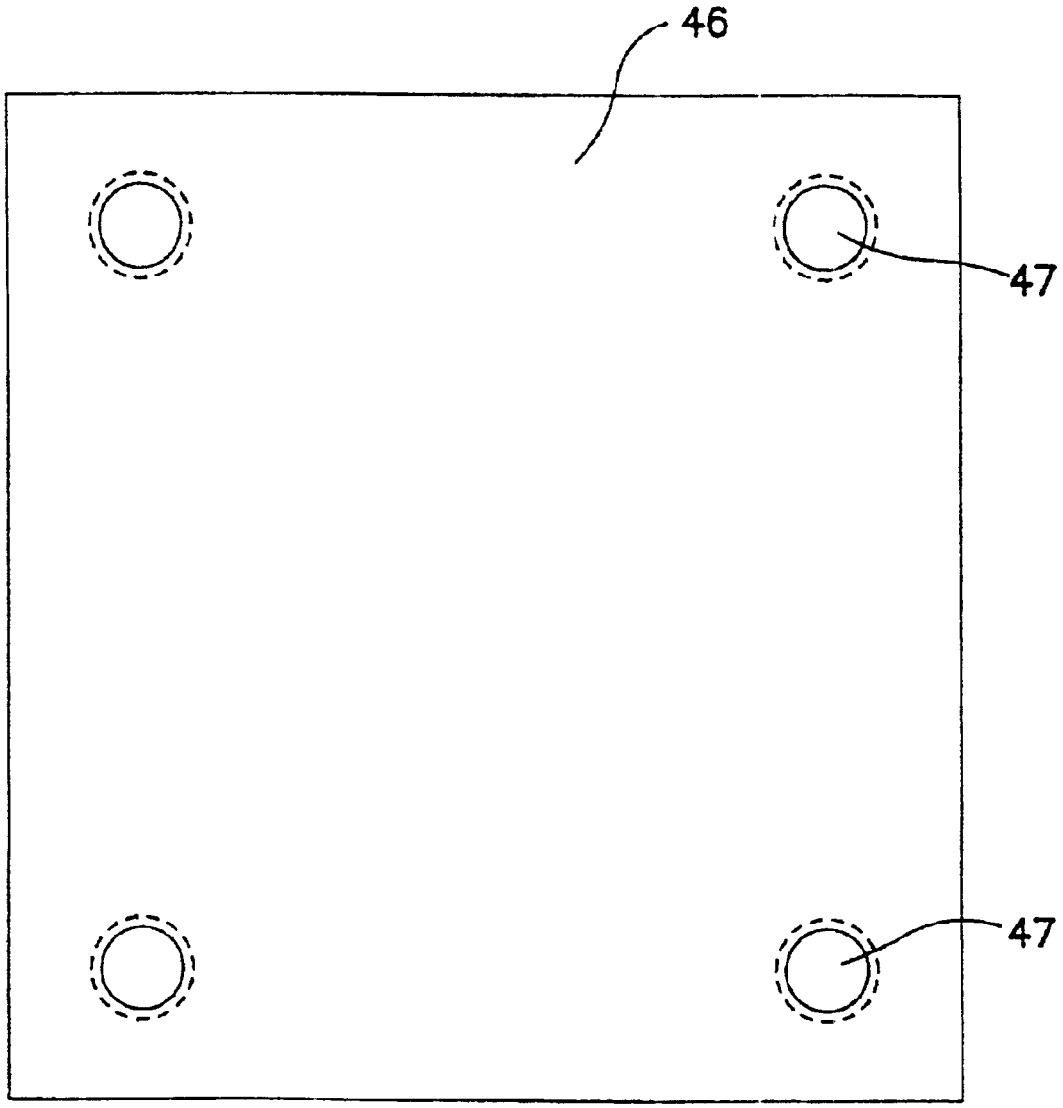
FIG. 12 is a front view of a guide mounting plate, in accordance with one embodiment of this invention.

At least a portion of a cylindrical guide bushing 50 is positioned within the cylindrical cavity 44 formed by the bushing housing 40. The guide bushing 50 is desirably, but not necessarily, made of bronze. The guide bushing 50 has an outer diameter slightly smaller than the diameter of the cavity 44 to allow the guide bushing 50 to fit tightly within the cavity 44 while allowing the bushing housing 40 to rotate with respect to the guide bushing 50. The outer surface of the guide bushing 50 may have at least one oil groove 51. Application of a suitable oil or other lubricant ensures proper rotation of the bushing housing 40 with respect to the guide bushing 50 without undesired friction and/or binding. As shown in FIGS. 10 and 11, the cylindrical guide bushing 50 forms a bore 52 having a cross-sectional area about equal to but slightly larger than the cross-sectional area of the guide shaft 36. With the guide bushing 50 positioned within the cavity 44 of the bushing housing 40 and the bore 52 coaxially aligned with the bore 42, the bushing housing 40 and the guide bushing 50 are positioned about the circumference of the guide shaft 36, as shown in FIGS. 3–5. The bushing housing 40 and the guide bushing 50 are slidably movable along the y-axis defined by the length of the guide shaft 36 between the guide shaft clamp blocks 38 mounting the guide shaft 36 to the guide post 32. A bumper 60 may be positioned around the guide shaft 36 and against an inner surface 61 of at least one of the guide shaft clamp blocks 38 to prevent damage to the bushing housing and/or the guide shaft clamp block 38 when the bushing housing 40 contacts the inner surface 61. Desirably, the bumper 60 is made of an elastic rubber material, for example 95 durometer neoprene. Other suitable materials may be used to make the bumper 60.

As shown in FIGS. 3–5 and 12, the bushing housing 40 is securely attached or fastened to a guide mounting plate 46 for mounting a portion of the web forming machine 20 to the support 30, for example at a side portion 24 and 26. The guide mounting plate 46 desirably has a plurality of apertures 47 for fastening the web forming machine 20 to the support 30 using conventional fastening means, for example bolts and screws.

In one embodiment of this invention, the web forming machine 20 is mounted at the first side portion 24 to the bushing housing 40 attached to a first guide shaft 36 and at the second laterally opposing side portion 26 to the bushing housing 40 attached to a corresponding second guide shaft 36 positioned on an opposing side of the web forming machine 20. Any suitable number of corresponding supports 30 may be positioned along the length of the web forming machine 20, for example five pairs of supports 30, equaling ten supports 30, as shown in FIG. 2.

Figure 15:
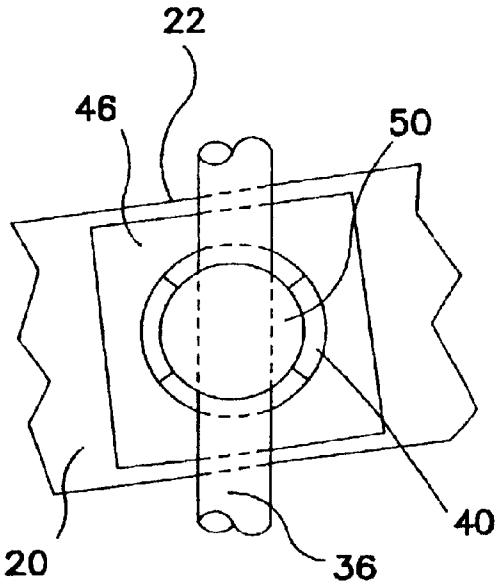
FIG. 15 is a partial front view of a support for a web forming machine showing rotation of the web forming machine about a x-axis with respect to the support, in accordance with one embodiment of this invention.
Figure 14:
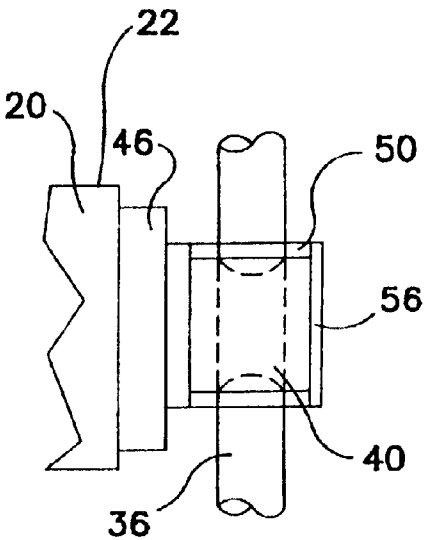
FIG. 14 is a partial side view of a support for a web forming machine, in accordance with one embodiment of this invention.
Figure 13:
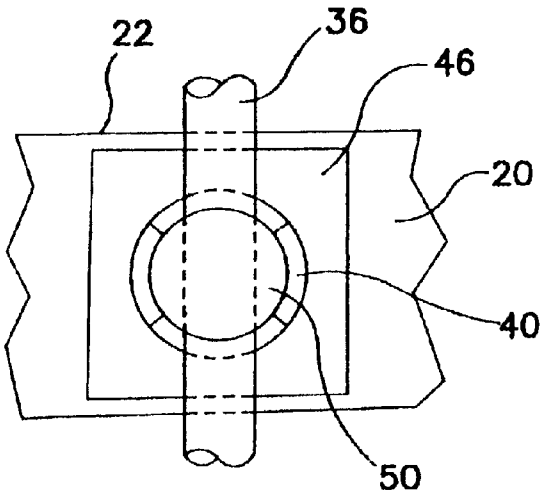
FIG. 13 is a partial front view of a support for a web forming machine, in accordance with one embodiment of this invention.

Referring to FIGS. 13–15, the bushing housing 40 and the guide bushing 50 are slidably movable along the length of the guide shaft 36 to position the web forming belt 22 vertically with respect to the die head 25 positioned above the web forming belt 22. During polymer extrusion applications, it is often desirable to increase or decrease the vertical distance between the web forming belt 22 and the successive die heads 25. For example, a first vertical distance between a first die head 25 and the web forming belt 22 may be about 12 inches, a second vertical distance between a second die head 25, downstream from the first die head 25, and the web forming belt 22 may be about 13 inches, and a third vertical distance between a third die head 25, downstream from the second die head 25, and the web forming belt 22 may be about 14 inches. As the vertical distances between successive die heads 25 and the web forming belt 22 increase or decrease, the web forming belt 22 will have either a positive or negative slope, respectively, with respect to a base of the web forming machine 20. In accordance with one embodiment of this invention, the web forming belt 22 may slope, from a first end portion to a second end portion, as much as about 12 inches to about 13 inches. In other embodiments of this invention, the slope may be greater. Further, as a result of the slope of the web forming belt 22, a distance between a front side of each die head 25 and the web forming belt 22 may be shorter than a distance between a back side of each die head 25 and the web forming belt 22.

In order to prevent the web forming belt 22 from mechanically binding as a result of the vertical positioning of the web forming belt 22 with respect to the die heads 25, the bushing housing 40 is rotatable about the x-axis, traverse to the machine direction and perpendicular to the y-axis.

The vertical positioning of the web forming belt 22 with respect to the die heads 25 is accomplished by slidably moving the bushing housing 40 along the length of the guide shaft 36. Once the web forming belt 22 is positioned at a desired vertical distance from the die head 25, the bushing housing 40 is fixedly mounted to the guide shaft 36 to prevent undesired linear displacement of the bushing housing 40 along the y-axis defined by the length of the guide shaft 36. The length of the guide shaft 36 between the guide shaft clamp blocks 38 limits the linear motion of the bushing housing 40.

As shown in FIG. 15, the bushing housing 40 is rotatable about the x-axis with respect to the guide bushing 50 to provide a generally flat outer surface of the web forming belt 22 and prevent mechanical binding and/or bending of the web forming belt 22 as it moves across the support 30. The axial or rotational positioning and/or adjustment of each support 30 may be simultaneous with or subsequent to the vertical positioning and/or adjustment of each support 30. In accordance with one embodiment of this invention, the rotational or axial motion of the bushing housing 40 with respect to the guide bushing 50 is limited within a range of about 0° to about 45°. The rotational or axial motion of the bushing housing 40 is limited by the length of the major axis of the bore 42. In accordance with other embodiments of this invention, the rotational or axial motion of the bushing housing 40 with respect to the guide bushing 50 may be limited to about 0° to about 360° depending on the mounting arrangement of the web forming machine 20 to the support 30.

Thus, the support 30 allows linear motion along the y-axis defined by the length of the guide shaft 36 while preventing linear motion along the x-axis and a z-axis, e.g. the two axes perpendicular to the y-axis. Further, the support 30 allows rotational or axial motion about the x-axis perpendicular to the y-axis but prevents rotational motion about the y-axis and the z-axis.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A support for a web forming machine having at least one die head and a web forming belt defining a machine direction, comprising:

a guide shaft having a length defining a y-axis;

a bushing housing having a cylindrical cavity; and a cylindrical guide bushing positioned within the cylindrical cavity, the bushing housing and the guide bushing slidably positioned about a circumference of the guide shaft;

wherein the bushing housing is rotatable about a x-axis generally perpendicular to the y-axis.

2. The support of claim 1, wherein the web forming machine is connected at a first side portion to the bushing housing.

3. The support of claim 1, wherein the die head is positioned traverse to the machine direction.

4. The support of claim 1, wherein the bushing housing and the guide bushing are movable along the length of the guide shaft to vary a vertical distance between the die head and the web forming belt.

5. The support of claim 1, wherein the guide shaft is rigidly mounted to a guide post.

6. The support of claim 5, wherein the guide shaft is mounted to the guide post with at least one guide shaft clamp block.

7. The support of claim 5, wherein the guide post is rigidly mounted to a base.

8. The support of claim 1, wherein the bushing housing forms a bore having an oval cross-sectional area.

9. The support of claim 8, wherein the guide bushing forms a second bore, the second bore coaxially aligned with the bore formed by the bushing housing.

10. The support of claim 1, wherein the bushing housing is rotatable by about 0° to about 45° about the x-axis.

11. A web forming machine support, comprising:

a guide shaft rigidly mounted to a guide post, the guide shaft having a length defining a y-axis;

a bushing housing positioned about a circumference of the guide shaft, the bushing housing rotatable about a x-axis generally perpendicular to the y-axis and slidably movable along the length of the guide shaft; and a cylindrical guide bushing positioned within the bushing housing and about the circumference of the guide shaft;

wherein the web forming machine is mounted to the bushing housing, the web forming machine having a web forming belt linearly displaceable along the y-axis.

12. The web forming machine support of claim 11, further comprising:

a second guide shaft laterally positioned with respect to the first guide shaft and rigidly mounted to a second guide post;

a second bushing housing positioned about a circumference of the second guide shaft, the second bushing housing rotatable about the x-axis and slidably movable along a length of the second guide shaft; and a cylindrical second guide bushing positioned within the second bushing housing and about the circumference of the second guide shaft;

wherein the web forming machine is mounted to the second bushing housing.

13. The web forming machine support of claim 11, wherein the guide post is rigidly mounted to a floor.

14. The web forming machine support of claim 12, wherein the bushing housing is vertically positioned along the length of the guide shaft and the second bushing housing is vertically positioned along the length of the second guide shaft to adjust a vertical position of the web forming belt along the y-axis.

15. A support for a web forming machine having a web forming belt defining a machine direction, comprising:

a first guide post positioned on a first side of the web forming machine and rigidly mounted to a base;

a first guide shaft rigidly mounted to the first guide post;

a second guide post positioned on a second side of the web forming machine and rigidly mounted to the base;

a second guide shaft rigidly mounted to the second guide post;

a bushing housing connected to each of the first guide shaft and the second guide shaft, the bushing housing forming a cavity; and a cylindrical guide bushing positioned within the cavity, the bushing housing and the guide bushing slidably positioned about a circumference of each of the first guide shaft and the second guide shaft and movable along a length of the first guide shaft and the second guide shaft;

wherein the web forming machine has a first lateral side portion and a second lateral side portion, the first lateral side portion fixedly connected to the bushing housing on the first guide shaft and the second lateral side portion fixedly connected to the bushing housing on the second guide shaft;

wherein the bushing housing is rotatable about a x-axis traverse to the machine direction and linearly displaceable with respect to a first die head along a y-axis perpendicular to the x-axis.

16. The support of claim 15, wherein a distance between a front side of the first die head and the web forming belt is shorter than a distance between a back side of the first die head and the web forming belt.

17. The support of claim 15, wherein a vertical distance between the first die head and the web forming belt is adjustable.

18. The support of claim 15, wherein a second die head is positioned downstream in the machine direction of the first die head.

19. The support of claim 18, wherein a first vertical distance between the first die head and the web forming belt is different than a second vertical distance between the second die head and the web forming belt.

* * * * *